United States Patent [19]

Cochran

[11] Patent Number: 4,721,487

[45] Date of Patent: Jan. 26, 1988

[54] LIFE LINE APPARATUS

[76] Inventor: Newton J. Cochran, One Elm Ave., Welloston, Mass. 02170

[21] Appl. No.: 1,520

[22] Filed: Jan. 8, 1987

[51] Int. Cl.[4] ..... B63C 9/26

[52] U.S. Cl. ..... 441/80; 441/84; 114/362

[58] Field of Search ..... 441/80, 84, 101-103, 441/108, 117, 106; 114/343, 362, 364, 363; 182/3, 8, 190, 196, 230

[56] References Cited

U.S. PATENT DOCUMENTS

| | | | |
|---|---|---|---|
| 665,240 | 1/1901 | Livonius | 441/84 |
| 2,368,558 | 1/1945 | Maloney | 441/84 |
| 3,095,587 | 7/1963 | Whalen | 441/84 |
| 3,216,030 | 11/1965 | Garfield | 441/84 |
| 3,587,123 | 6/1971 | O'Boyle | 1.4/362 |
| 4,519,783 | 5/1985 | Burke | 441/117 |

*Primary Examiner*—Joseph F. Peters, Jr.
*Assistant Examiner*—Stephen P. Avila
*Attorney, Agent, or Firm*—Gilden & Israel

[57] ABSTRACT

A life jacket is provided with a pocket in which a length of line is retained. A suction cup device is attached to a free end of the line so that the user may attach the suction cup to a capsized boat or the like. A modified embodiment includes a plurality of the suction cups attached to a length of line which permits a user to form a set of hand holds or steps so that he can easily climb upon a capsized boat.

1 Claim, 3 Drawing Figures

FIG 1
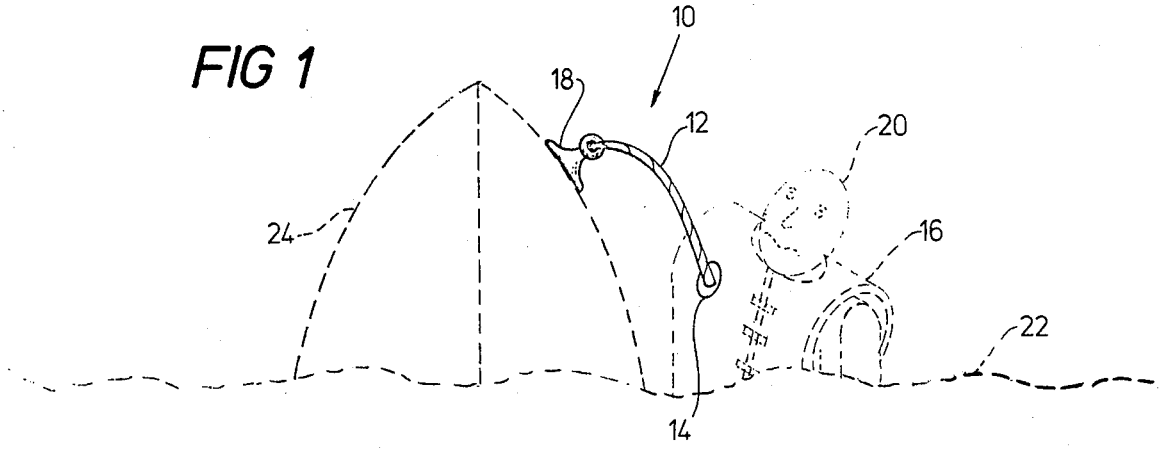
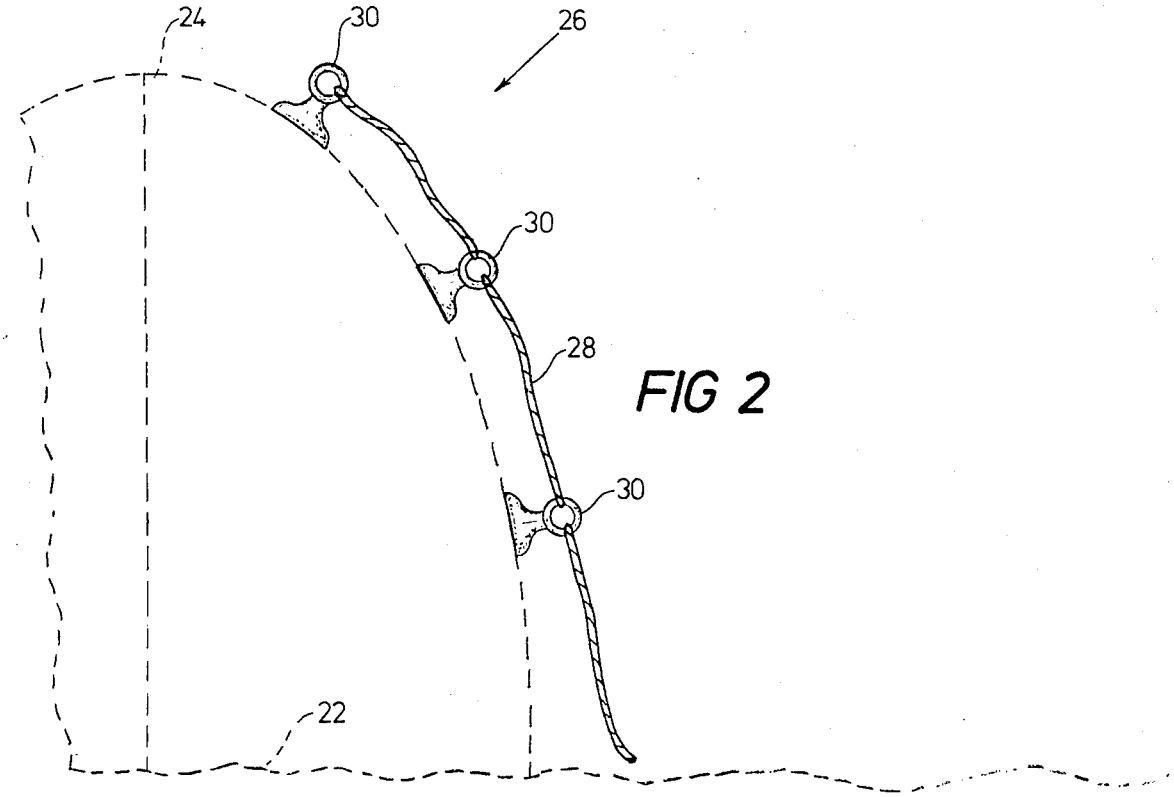
FIG 2

LIFE LINE APPARATUS

BACKGROUND OF THE INVENTION

1. Field of the Invention

The present invention relates to life saving devices, and more particularly pertains to a new and improved life line apparatus which is attached to and retained within a life jacket.

2. Description of the Prior Art

The use of various life line apparatuses which permit users to become attached to and stay in the vicinity of a capsized boat are well known in the prior art. For example, U.S. Pat. No. 665,240, which issued to O. Livonius on Jan. 1, 1901, describes the structure of a life boat which facilitates an attachment of individuals to its bottom when in a capsized condition. The Livonius lifeboat includes a plurality of permanently attached, outwardly extending members on a bottom portion of its hull, which a further plurality of life lines being fixedly secured to these members. The life lines are normally retained within the boat and have floats attached to their free ends. In the event of a boat capsize the floats bring the life lines to the surface of the water so that they can be grasped by individuals no longer in the boat, thereby to permit the individuals to remain attached to the capsized structure. While being functional for its intended use, it can be appreciated that the basic design of this invention is impractical due to the fact that the permanently attached members on the bottom of the boat hull would seriously impede the movement of the boat through the water. As such, no apparent commercial success for this device has been realized.

Another type of life line apparatus is illustrated in U.S. Pat. No. 3,216,030, which issued to J. Garfield on Nov. 9, 1965. The Garfield apparatus essentially comprises a coiled life line normally retained within the boat and having one end thereof permanently attached along an inside edge of the gunnel. In the event of boat capsize, the life line will hang downwardly from the gunnel so that it can be grasped by individuals in the water, and can then be tossed over the capsized hull to be further attached to a hook on the opposed interior gunnel. Loops may be permanently provided in the life line so that the individuals can then climb upon the capsized boat hull. Unfortunately, this apparatus has also met with little commercial success due to the apparent difficulty of retrieving the line from the gunnel when the boat is capsized. More particularly, it is obvious that the gunnel could be several feet under water, which would make it virtually impossible for individuals wearing life jackets to find and retrieve the dangling line, to subsequently toss it over the boat hull, and to attach it to an interior portion of the capsized boat.

There has been at least one attempt to permanently attach a life line directly to a life jacket so as to improve a user's chances of attaching himself to a capsized boat or some other structure. In this respect, reference is made to U.S. Pat. No. 3,095,587 which issued to M. Whalen on July 2, 1963. The Whalen life jacket includes a small attached plastic reel having a length of line wound thereon. A hook is provided on the free end of the line, so that a wearer of the life jacket can unwind the line and attach it to a capsized boat—provided that he can find an appropriate attachment point. While possibly being functional for its intended purpose, it would appear that most capsized boat hulls would be substantially slippery and smooth so as to not afford an appropriate attachment structure for such a life line.

As such, it would appear that there exists a continuing need for new and improved life line apparatuses which would facilitate the tethered attachment of a floating individual to a capsized boat without undue difficulty, and in this respect, the present invention substantially fulfills this need.

SUMMARY OF THE INVENTION

In view of the foregoing disadvantages inherent in the known types of life saving apparatuses now present in the prior art, the present invention provides an improved life saving apparatus wherein the same can be compactly stored within a life jacket and is utilizable to easily and efficiently effect a tethered attachment of a life jacket wearer to the bottom of a capsized boat. As such, the general purpose of the present invention, which will be described subsequently in greater detail, is to provide a new and improved life saving apparatus which has all the advantages of the prior art life saving apparatuses and none of the disadvantages.

To attain this, the present invention essentially comprises a life jacket having an attached length of life line retained within a pocket formed therein. A free end of the life line is provided with a suction cup device so that a wearer of the jacket can remove the line and effect an attachment thereof to the bottom of a capsized boat. In a modified embodiment of the invention, a plurality of suction cup devices are attached to and spaced apart along a length of the line so that the wearer can attach the several suction cup devices to the bottom of the boat. In this respect, the suction cup devices can be attached progressively upwardly along the boat bottom so as to permit the jacket wearer to completely climb out of the water by utilizing the spaced apart suction cup devices as steps or handholds.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved life line apparatus which has all the advantages of the prior art life line apparatuses and none of the disadvantages.

It is another object of the present invention to provide a new and improved life line apparatus which may be easily and efficiently manufactured and marketed.

It is a further object of the present invention to provide a new and improved life line apparatus which is of a durable and reliable construction.

An even further object of the present invention is to provide a new and improved life line apparatus which is susceptible of a low cost of manufacture with regard to both materials and labor, and which accordingly is then susceptible of low prices of sale to the consuming public, thereby making such life line apparatuses economically available to the buying public.

Still yet another object of the present invention is to provide a new and improved life line apparatus which provides in the apparatuses and methods of the prior art some of the advantages thereof, while simultaneously overcoming some of the disadvantages normally associated therewith.

Still another object of the present invention is to provide a new and improved life line apparatus permanently attached to a life jacket, thereby to facilitate access thereto and the availability thereof.

Yet another object of the present invention is to provide a new and improved life line apparatus which may be quickly and efficiently attached to the smooth bottom of a capsized boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes refernce to the annexed drawings wherein:

FIG. 1 is a perspective view of a first embodiment of the life line apparatus comprising the present invention.

FIG. 2 is a side elevation view of a second embodiment of the invention.

DESCRIPTION OF THE PREFERRED EMBODIMENTS

Figure 3:
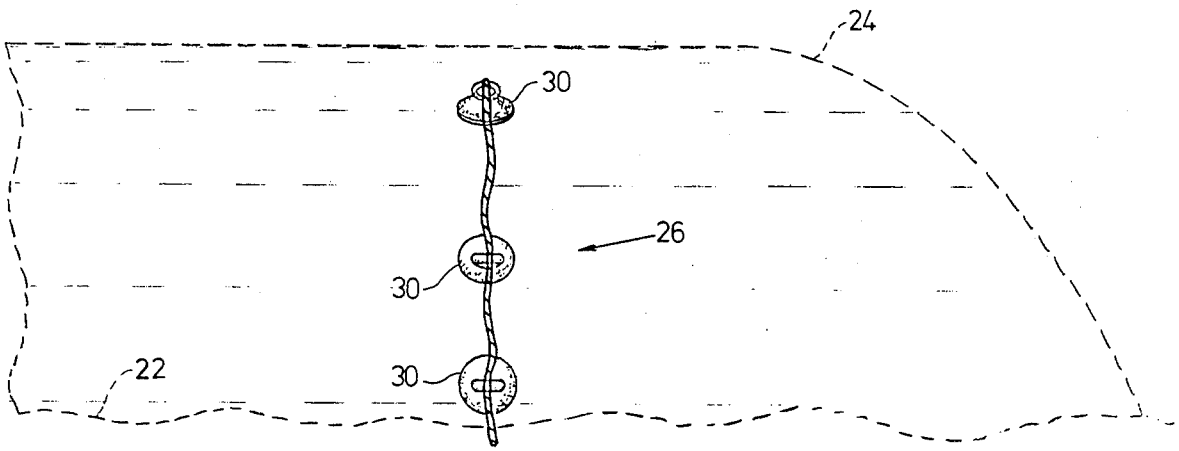
FIG. 3 is a front elevation view of the second embodiment of the invention.

With reference now to the drawings, and in particular to FIG. 1 thereof, a new and improved life line apparatus embodying the principles and concepts of the present invention and generally designated by the reference numeral 10 will be described.

More specifically, it will be noted that the life line apparatus 10 essentially comprises a length of life line 12 which is retained within a pocket 14 formed in a conventional life jacket 16. The length of the line 12 is variable, depending upon the size of the pocket 14, and one free end of the life line is permanently attached by some conventional means to the life jacket 16. A suction cup device 18 is secured in a conventional manner to the remaining free end of the life line 12, with the pocket 14 being of a sufficient size to also facilitate a retention of the suction cup device therein.

With respect to the manner of usage and operation of this first embodiment 10 of the invention, it can be appreciated that a wearer 20 of the life jacket 16 may manually remove the suction cup device 18 and its attached life line 12 from the pocket 14 while he is in the water 22. Assuming that the hull 24 of a capsized boat is still extending above the water 22, the jacket wearer 20 can quickly and efficiently attach the suction cup 18 thereto, thus to provide a tethering of the wearer to the hull. Further, a quick manual release of the suction cup device 18 is possible if the boat hull 24 moves beneath the surface of the water 22, thus to further protect the jacket wearer 20. In this respect, it is within the intent and purview of the present invention to include all known types of conventional suction cup devices 18, to include those types which operate with a manually movable handle to effect a desired suction attachment. Accordingly, the claims appended hereto encompass all known types of such suction cup devices.

FIGS. 2 and 3 of the drawings illustrate a modified embodiment of the life line apparatus comprising the present invention, with such modified embodiment being generally designated by the reference numeral 26. In this respect, the modified embodiment 26 includes the use of a life line 28 also retained within a life jacket pocket 14, and further utilizes a plurality of suction cup devices 30 attached to spaced apart lengths thereof.

With respect to the manner of usage of this modified embodiment 26 of the invention, a jacket wearer 20 can attach a first suction cup 30 on a lowermost portion of a boat hull 24 and using this first attached suction cup device to pull himself out of the water, a second suction cup device can then be attached on a higher portion of the hull. Pulling himself up onto the second suction cup device 30, the jacket wearer can then attach a further suction cup device on an even higher portion of the boat hull 24 so as to eventually completely climb out of the water. Again, some type of quick release mechanism can be provided between the life line 28 and the life jacket 16 in the event that the boat hull 24 moves beneath the surface of the water 22.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompased by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A life line apparatus, comprising:

a. life jacket means securable to a user;

b. flexible life line means fixedly secured to said life jacket means;

c. pocket means formed in said life jacket means, said flexible life line means being removably retained within said pocket means; and, d. suction cup attachment means secured to a free end of said flexible life line means, said suction cup attachment means being removably retained within said pocket means, said suction cup attachment means comprising a plurality of suction cups fixedly secured along spaced apart sections of said flexible life line means, thereby to permit said user to utilize said plurality of suction cups as steps to climb upon a structure.

* * * * *